United States Patent [19]

Corona et al.

[11] Patent Number: 4,463,788

[45] Date of Patent: Aug. 7, 1984

[54] MULTIPLE BIT SCREWDRIVER

[75] Inventors: Antonio Corona, Kettleby; Paul F. Ho, Etobicoke, both of Canada

[73] Assignee: Antonio Corona & Associates R & D Ltd., Kettleby, Canada

[21] Appl. No.: 502,675

[22] Filed: Jun. 9, 1983

[51] Int. Cl.[3] ..... B25G 1/08

[52] U.S. Cl. ..... 145/63

[58] Field of Search ..... 145/63, 62

[56] References Cited

U.S. PATENT DOCUMENTS 3,405,749 10/1968 Butler ..... 145/63

*Primary Examiner*—Frederick R. Schmidt

*Assistant Examiner*—J. T. Zatarga

*Attorney, Agent, or Firm*—Sim & McBurney

[57] ABSTRACT

A multi-bit screwdriver comprises a handle with a bit selector cup rotatably mounted at its end. A plurality of bits are provided in a circular pattern within a handle magazine. A chuck is provided at the handle end for receiving a bit end and securing it against rotation. The cup has a continuous side wall with an interior surface spaced radially outwardly of the radial location of the bits. An elongate slot is provided in the cup end extending from the central portion of the cup radially outwardly to the radial location of the bits in the handle. The cup is rotatable to permit selection of a desired bit and withdraw it from the magazine. The bit end is retained in the cup for lateral transfer along the slot into registration with the chuck.

18 Claims, 12 Drawing Figures

MULTIPLE BIT SCREWDRIVER

FIELD OF THE INVENTION

This invention relates to handtools having multiple bit provision and more particularly, to screwdrivers with interchangeable bits which are captured within the screwdriver.

BACKGROUND OF THE INVENTION

There are presently available on the marketplace many forms of multi-bit screwdrivers where the several bits are contained within the hollow handle. When it is desired to use a particular bit, the handle is opened by unscrewing a cap for the handle and selecting the needed bit. The selected bit is then placed in the chuck at the other end of the handle for use. Unfortunately this system results in loss of bits because the bits are not retained with the screwdriver handle.

To overcome this problem, many screwdriver configurations have been suggested. For example, Butler, U.S. Pat. No. 3,405,749, discloses a multi-chambered tool holder. Several bits are held in the chambers in the handle. A truncated cone is provided at the end of the handle with a disc portion. The disc has a figure 8 shaped slot. When the disc is aligned with an end of one of the chambers in the handle, a bit can be extracted downwardly through the cone and inserted in the chuck portion of the handle. Due to the shape of the cone, the bits used in the system are presumably very short. Obviously with short bit arrangements, they do not lend themselves to many applications since a short bit makes it difficult to get into cramped places. In addition in order to negotiate the turn with the bit, most likely the hole 42 in the cone is enlarged which will probably allow the bit to fall out through the cone, thus a feature of retaining the bits in the driver is not provided.

An approach to retaining the bits in the screwdriver at all times is disclosed in U.S. Pat. No. 3,194,286. In that arrangement, the handle has a magazine of several bit configurations. By rotating the tapered lower portion 12, a desired bit may be selected. A chuck 14 is provided at the base of the tapered portion which secures the screwdriver bit. The bits are retained in the chuck by way of a rod extending through the chuck device to hold the bit in the chuck.

Another multi-chamber tool handle arrangement is disclosed in U.S. Pat. No. 3,006,395. The selected bit travels downwardly through a central channel in the handle and chuck portion, where the selected bit can be secured in the chuck. Another more complex arrangement to accomplish the same purpose is disclosed in U.S. Pat. No. 2,765,013 where linkage mechanisms are used to extend the desired bit beyond the handle. Another complex arrangement for a multi-chamber screwdriver is disclosed in U.S. Pat. No. 3,753,455 where the desired bit may be extracted from the handle and extended from a chuck portion. All of these arrangements require slanting the bit for purposes of selection and extension. Due to extended use of such tools as they become dirty and corroded, the smooth operation of the tool may be lost.

A direct extraction of the bit from a multi-bit handle is disclosed in U.S. Pat. Nos. 512,911 and 4,241,773. Unfortunately with these arrangements, the bit is off centre relative to the central axis of the handle resulting in an eccentric motion when the screwdriver is used. Thus the tool can only be used for the simplest of jobs.

The multi-bit screwdriver, according to this invention, overcomes a number of the above problems in providing a structure which is durable, easy to operate and is readily manufactured by injection molding of plastics.

SUMMARY OF THE INVENTION

According to an aspect of the invention, the multi-bit screwdriver comprises a handle with a central longitudinal axis and a bit selector cup rotatably mounted at an end of the handle to rotate about the central axis. A plurality of bits are provided in a circular pattern about the handle axis. Each of the bits is contained in the handle to extend parallel to the handle axis. The chuck is provided at the handle end aligned with the handle axis for receiving a bit end and securing it against rotation. The cup has a continuous side wall with an interior surface spaced radially outwardly of the radial location of the bits and a closed cup end. An elongate slot extends from the central portion of the cup end radially outwardly to the radial location of the bits in the handle. The cup is rotatable to position the slot in register with any desired bit of the handle. The slot in the cup end is of sufficient width and length to permit outward withdrawal of the bit from the handle in a direction generally parallel with the handle axis. Means retains the tool bit end in the cup. The bit end is movable along the slot toward the cup centre into alignment with the chuck for insertion of the tool bit into the chuck. The tool is now ready for use. After use, the tool bit may be removed from the chuck and returned to within the handle.

BRIEF DESCRIPTION OF THE DRAWINGS

Various preferred embodiments of the invention are shown in the drawings wherein.

DETAILED DESCRIPTION OF THE PREFERRED EMBODIMENTS

Figure 1:
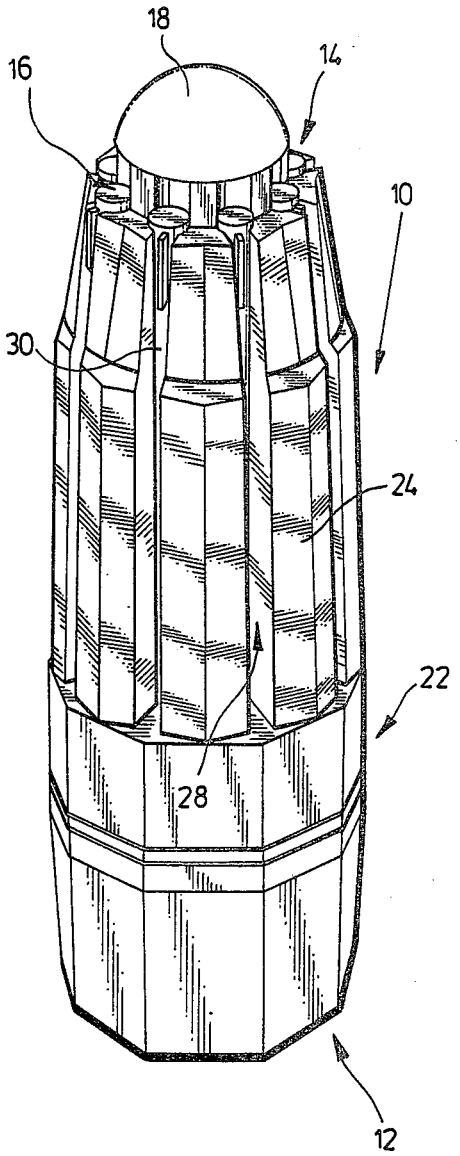
FIG. 1 is a perspective view of the multi-bit screwdriver in its normal unused position.
Figure 2:
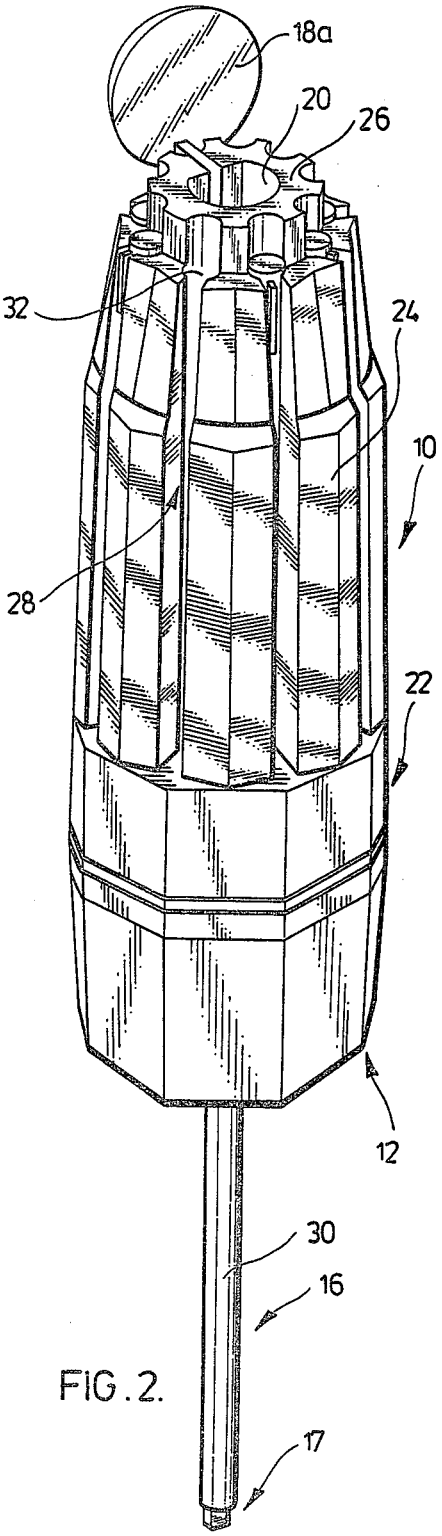
FIG. 2 is a perspective view of the screwdriver of FIG. 1 with a bit in position for use.

The preferred embodiment for the screwdriver, as shown in FIG. 1, consists of a screwdriver handle 10, and a rotatable cup 12. A magazine generally indicated as 14 is provided for holding a plurality of tool bits, the upper portion 16 of each bit is visible through the wall portions of the handle 10. A dome-shaped cap 18 is provided above the handle which may be pivoted to the open position 18*a* as shown in FIG. 2 to expose a storage space 20 centrally of the handle 10. Various and sundry items may be provided in the storage space 20 such as lubricants, glue and the like.

According to this preferred embodiment, the handle 10 has a very characteristic shape, where the lower portion 22 of the handle is of a polygonal shape. According to this embodiment, the handle magazine 14 holds nine bits to provide a polygonal shape 22 with nine sides, commonly referred to as an enneagon. Extending upwardly from the enneagonal portion 22 are pillars 24 which are integral with the handle central body 26, as shown in FIG. 2. The pillars 24 are spaced apart as at 28 to visibly show the shaft portion 30 of the tool bit 16. By way of the pillars 24 being integral with the central body portion 26 of the handle, a plurality of elongate channels 32 are provided in the handle 10 to form the multi-bit chamber or magazine arrangement 14. The channels 32 extend through the polygonal portion 22 to permit withdrawal of the bit 16 downwardly of the handle 10 in a manner to be described in more detail with respect to FIG. 6. Should dirt or the like collect in the magazine, one by having access to the bit end through space 28 may force the bit downwardly of the handle portion to assist in its withdrawal.

Figure 3:
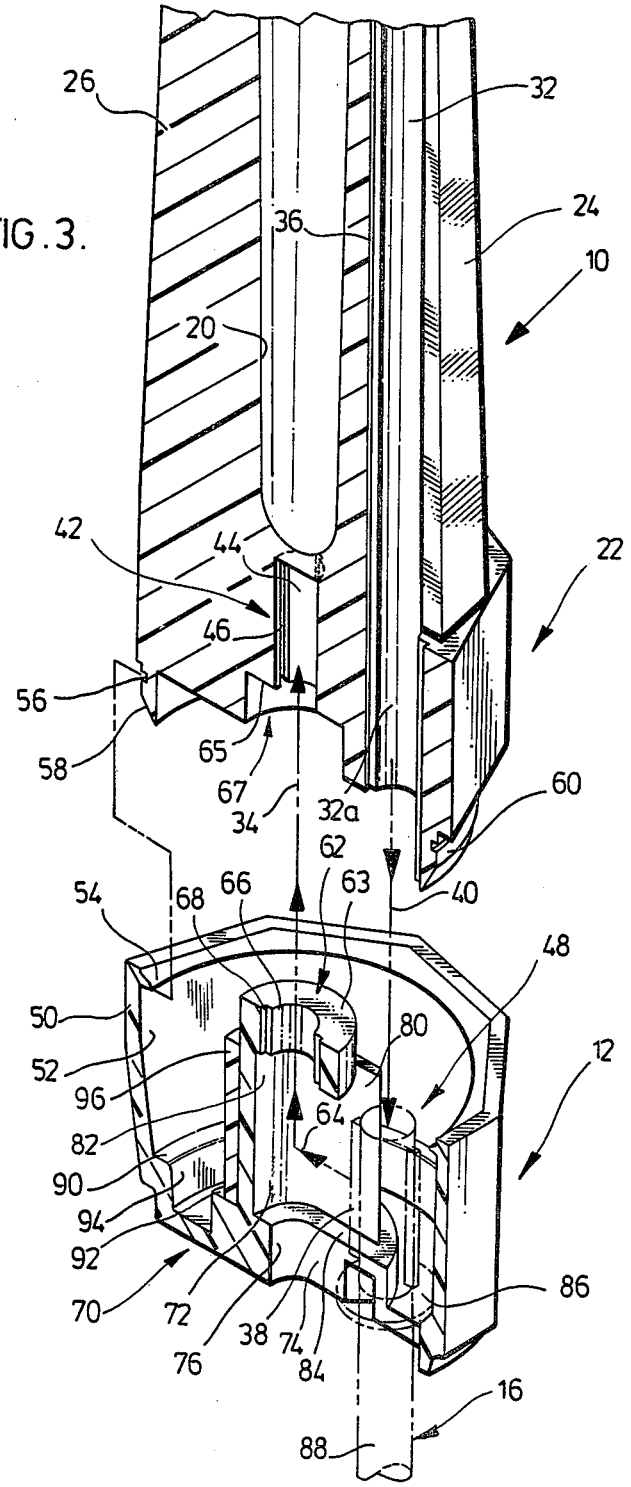
FIG. 3 is a section through the screwdriver of FIG. 1 with the rotatable cup portion removed to show the relationship of the elements.

Turning to FIG. 3, the interrelationship of the bit selector cup 12 to the handle 10 is shown in more detail. The handle body portion 26 has extending therethrough a channel 32 which extends in a direction parallel to the handle axis indicated by line 34. A longitudinally extending recess 36 is provided in the body portion 26 along the channel 32 to receive a lug 38 as shown in dot on the bit 16. This guides and fixes the position of the bit 16 as it is moved upwardly and downwardly of the channel 32. The channel 32 extends through the polygonal portion 22 in area 32*a* to provide for the downward withdrawal in the direction of arrow 40 of the bit 16. As shown in the section of FIG. 3, the extent of the space 20 within the handle is demonstrated in which sundry items may be stored.

The handle 10 is provided with a chuck 42 which is centered on the central axis 34 of the handle 10. The chuck 42 comprises a bore 44 in the body portion 26 of the handle. The cylindrical bore has spaced-apart grooves 46 which are shown in more detail in FIG. 4. Accordingly, about the bore 44 are four evenly spaced-apart grooves 46 to provide two pairs of diametrically opposing grooves. These grooves are of a shape to receive the lug portion 38 of the bit 16 on the bit end 48.

Figure 4:
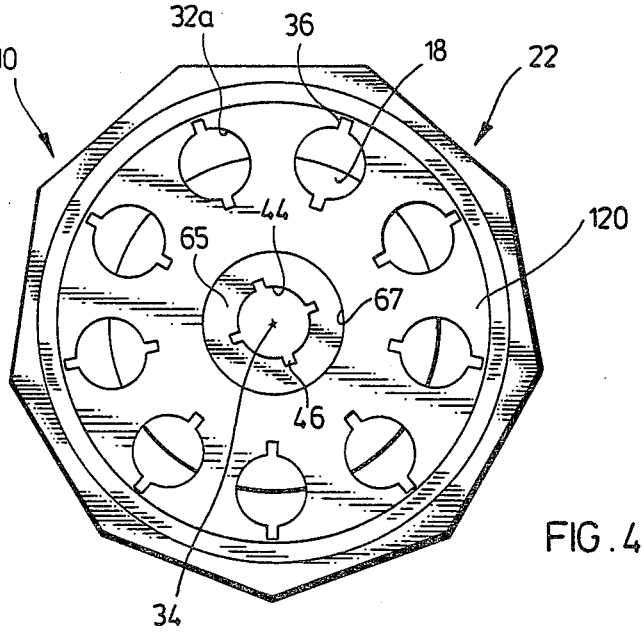
FIG. 4 is view of the bottom of the screwdriver handle with the cup removed.

Accordingly, FIG. 4 shows the bottom portion of the polygonal part 22 of the handle. The channels 32*a*, as they extend through the polygonal portion, have their grooves 36 provided to receive the lugs 38 of the bit end 48. The channels 32*a* are provided in a circular pattern concentric with the central axis 34 of the handle 10. The arrangement of the channels thereby provides a circular magazine for the bits as they all extend in a direction parallel to the axis 34 of the handle.

Figure 5:
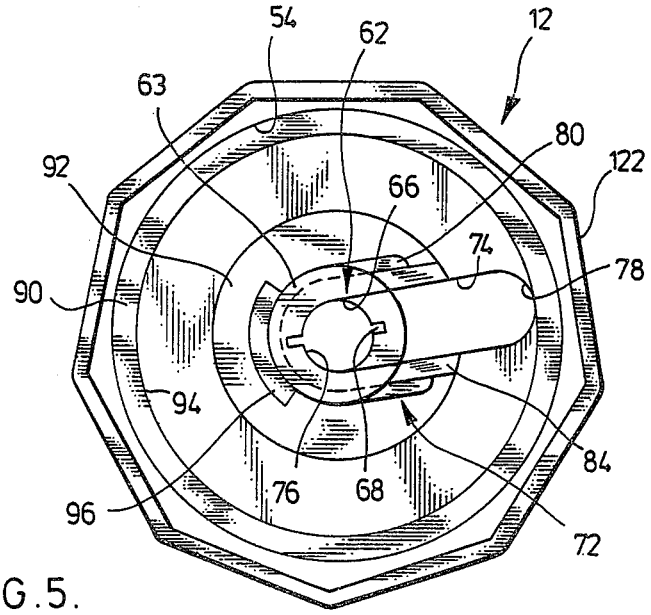
FIG. 5 is a top view of the interior of the rotatable cup of FIG. 3.

Returning to FIG. 3, further details of the cup 12 are shown. The cup has a side wall 50 with interior surface 52 which is spaced radially outwardly of the radial location of the bits as they rest in the various channels 32 of the circular magazine. On the upper portion of the cup 12 is an interior ring 54 which presents a continuous circular surface, as shown in FIG. 5. At the lower portion of the polygonal part 22 of the handle, is a corresponding circular groove 56. At the distal end of the handle is a tapered face 58 which initially contacts flange 54 to cam and guide its movement over the shoulder 60 so that the interior ring 54 may snap fit into the circular groove 56 on the handle. By this snap fit, the cup is rotatably secured to the handle 10 so as to rotate about the handle axis 34.

Internally of the cup 12 is a bushing 62 which is used to facilitate insertion of the bit end 48 into the chuck 44 and also to lock the bit in the chuck. The desired bit 16 is withdrawn from the chuck in the direction of arrow 40, transferred laterally in the direction of arrow 64 into alignment with bushing 62. The bushing 62 has a bore 66 with diametrically opposing grooves 68 as shown more clearly in FIG. 5. The bushing 62 is supported above the cup end 70 by a U-shaped element 72 as more clearly shown in FIG. 5. In the base of the cup 12 is an elongate slot 74 which has a circular portion 76 aligned with the bore 66 of the bushing 62. From that central area, the slot 74 extends radially outwardly of the cup end 70 to define circular portion 78 which is aligned with the respective channel portion 32*a* of the handle. Thus the slot 74 extends radially outwardly of the cup centre to slightly beyond the radial location of the bits 16 in the channels 32. The U-shaped element 72 has opposing leg portions 80 which extend along each side of the slot 74 to the rounded or semi-circular base portion 82. The U-shaped member is spaced from the slot to provide about the slot a ledge portion 84. In order to retain the bit end 48 within the cup so as to avoid losing the selected bit, a retaining device is provided for retaining the bit in the cup. According to this embodiment, the retaining device is a ring 86 which surrounds the bit shaft 88. The ring has an internal diameter less than that of the overall width of the lugs 38 to trap the bit end. The ring 86 rests on the ledge portion 84 as the bit end is moved laterally of the cup in the direction of arrow 64 to ensure that the bit end does not fall out of the cup.

The cup bottom 70 is provided with annular ledges 90 and 92 which are shown more clearly in FIG. 5. The ring rests on these ledges 90 and 92 with the bit in its retracted position. The width of the ring is such that the cup 12 may be rotated 360° without interferring with any other components parts within the cup. The bit end, that is the working portion of the bit at 17 as shown in FIG. 2, is located in the trough 94 defined between the ledges 90 and 92. The location of the bit end in the trough is determined by stop portions provided in the handle, which will be discussed in more detail with respect to FIG. 11.

Figure 7:
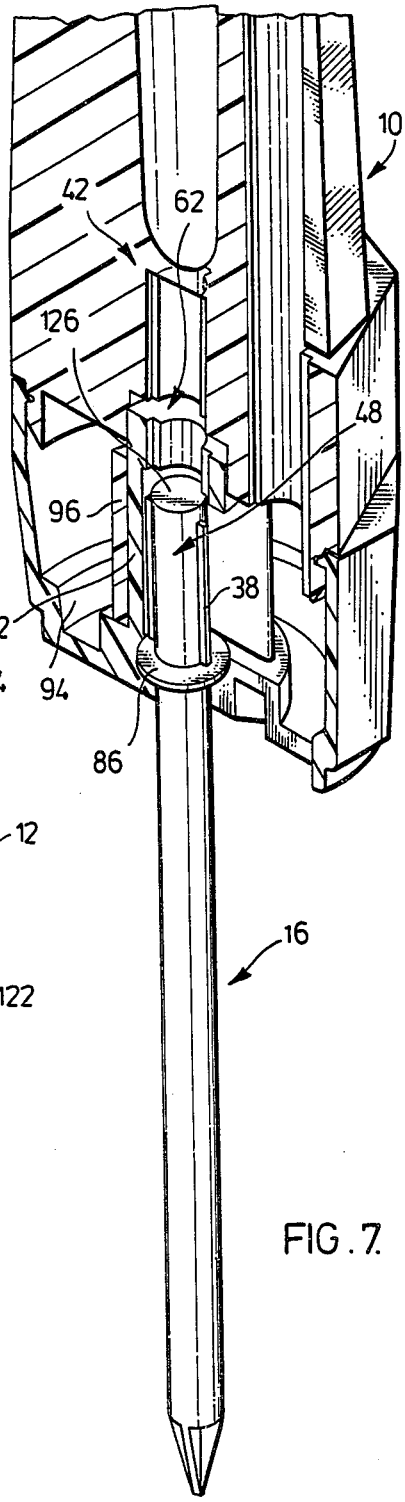
Figure 8:
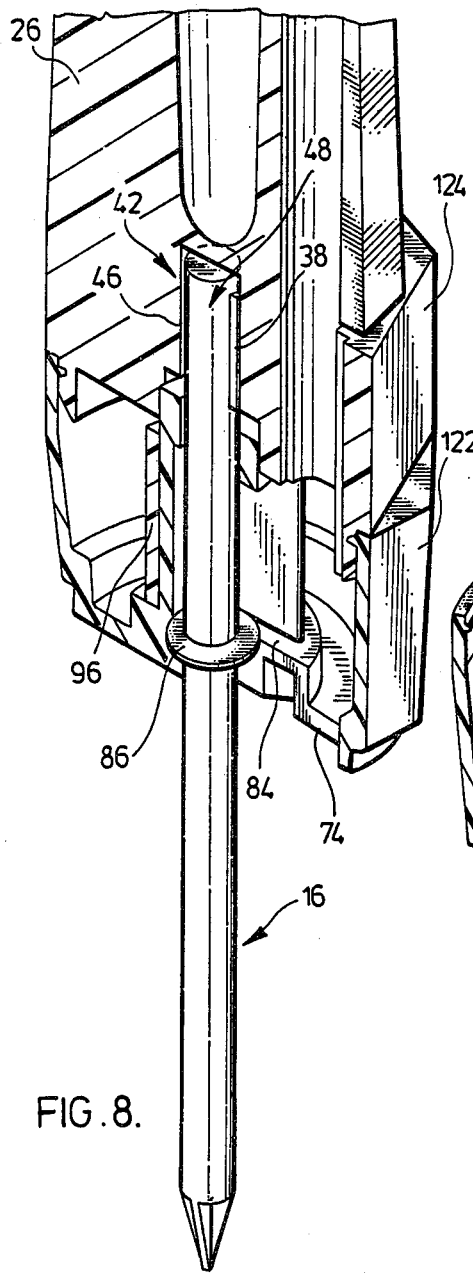

A magnet 96 is secured to the base portion 82 of the U-shaped element to attract the bit end 48 towards the bore 66 and assist in aligning it with that bore in the manner to be discussed with respect to FIG. 7. The bushing 62 has a planar upper surface 63 which is positioned adjacent annular surface 65 about the chuck 44 in the handle portion. The bushing 62 is received by opening 67 when the ring 54 is snapped over the groove 56.

Figure 10:
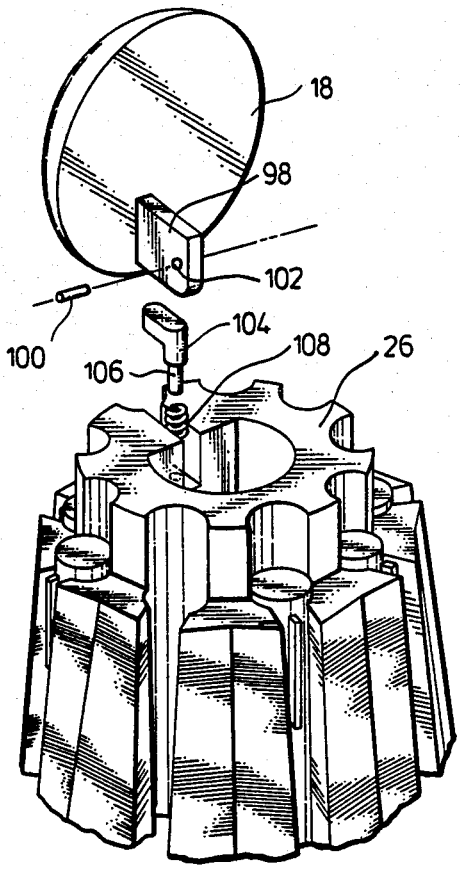
FIG. 10 is a perspective view of the upper portion of the screwdriver handle.
Figure 11:
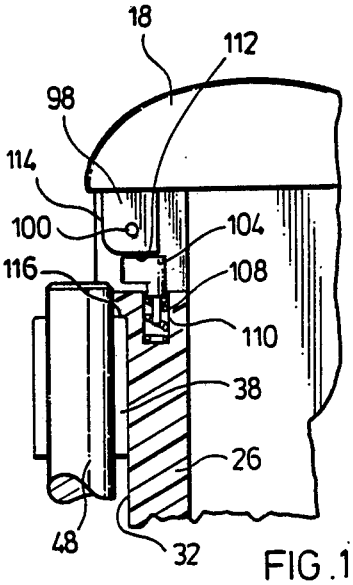
FIG. 11 is a section through a portion of the upper part of the screwdriver handle.
Figure 12:
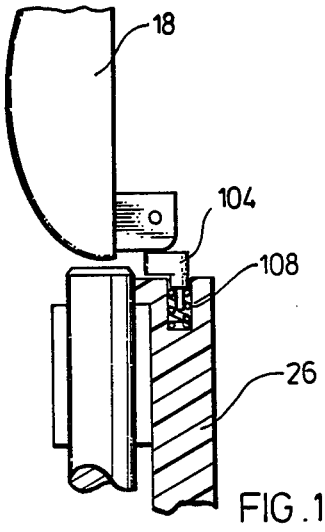
FIG. 12 is the same section as FIG. 11 with the lid for the interior of the hollow handle in its open position.

Further aspects of the structure of the multi-bit screwdriver are shown in FIG. 10 where a lid 18 is hinged to the body portion 26 of the handle 10 by way of a depending plate 98 which is pivotally connected to the body portion 26 by pin 100 extending through aperture 102. The pin 100 is connected to the body portion 26. Located beneath the pivotally connected plate 98 is a spring loaded catch 104. The catch has a depending shaft 106 surrounded by spring 108 which is compressed in recess 110 as shown in FIG. 11. Relative to the pivot point 100, the distance to face 112 of plate 98 compared to face 114 of plate 98 is less. Thus with the lid 18 in its closed position, the catch spring 108 is compressed to the extent shown. When it is desired to open the lid 18, the pawl 104 is depressed against the tension spring 108 to hold the lid in the open position. When it is desired to close the lid, it can be moved forward to snap close under the pressure of spring 108. As shown in FIG. 11, when the bit end 48 is fully inserted in the channel 32, the lug 38 abuts a stop 116. The purpose of the stop is to locate the stored bit relative to the cup trough 94, such that the working end 17 of the stored bit remains in the trough 94. The ring 86 is captured thereby on the bit shaft since the ring cannot fall away from the bit end with the ring supported on ledges 90 and 92 and secondly, with the bit fully inserted in the handle the ring can proceed no further than the underside 120 of the handle.

Figure 6:
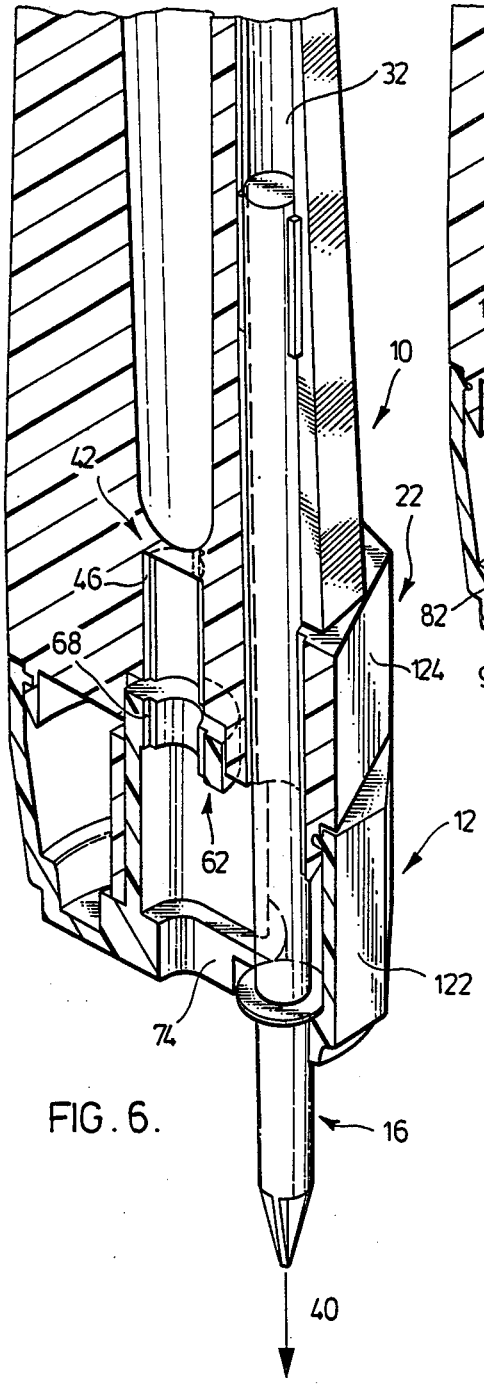
FIGS. 6, 7, 8 and 9 are sections through the screwdriver handle showing in sequence the withdrawal of a bit from the handle and insertion in the chuck portion for use.

Referring to FIGS. 6 through 9, the procedure for locating a desired bit in the chuck is demonstrated. A bit 16 of FIG. 6 is located in its respective channel 32 and may be withdrawn from the channel 32 in the direction of arrow 40. This is accomplished by rotating the cup 12 relative to the handle 10 so that the slot 74 becomes aligned with the desired bit 16. In order to take advantage of the polygonal shape of the screwdriver handle and the cup, an alignment of lug grooves in the bushing and chuck positions the slot 74 in the manner shown in FIG. 5 relative to the planar side wall portions 122 of the polygonal shaped cup. Thus as shown in FIG. 6 with the slot 74 aligned with the bit 16, the polygonal side walls 122 are misaligned or offset from the polygonal side walls 124 of handle portion 22. In this position, the diametrically opposing grooves 68 in the bushing 62 are aligned with corresponding diametrially opposing grooves 46 in the chuck 42. Two sets of diametrically opposing grooves 46 are provided in the chuck 42 to minimize the amount of rotation required in the event that when the bit 16 is withdrawn from the handle portion and the grooves 68 are not quite aligned with grooves 46 of the chuck. Markings may be provided on surfaces 122 and 124 to indicate clearly when the grooves 68 are aligned with the closest diametrically opposing pair of grooves 46 of the chuck 42. In FIG. 6, it so happens that the grooves 68 are aligned with the grooves 46 with the slot 74 in position to permit withdrawal of the bit from the handle portion.

Figure 9:
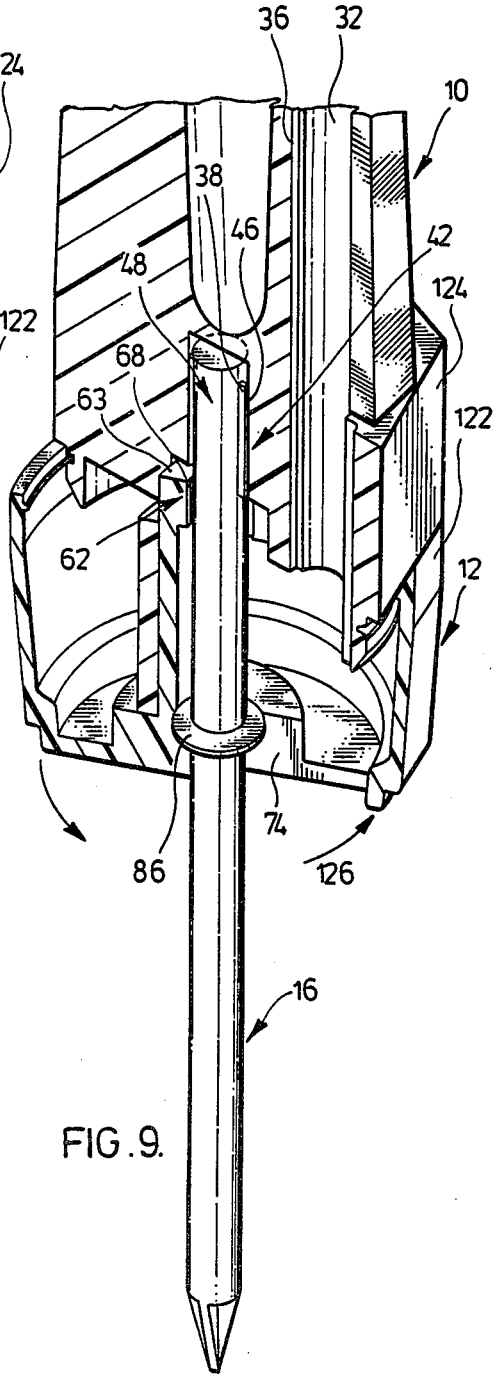

Once the bit 16 is withdrawn from the handle 10, such that the retaining ring 86 engages the lugs 38, the uppermost end 126 of the bit end 48 clears beneath the bushing 62. The bit 16 is transferred laterally in the direction of arrow 64 as shown in FIG. 3 to move into register with the chuck 42. The magnet 96, as located on the exterior of the U-shaped element base 82 assists and holds the bit 16 in register with the chuck 42. It is appreciated that at this point all the other bits (not shown) in FIG. 7 extend downwardly of the handle 10 into the trough 94 with their respective retaining rings resting on the ledges 90 and 92. Once the bit 16 is aligned with the chuck 42, it is inserted upwardly in the direction of arrow 34 of FIG. 3 with the lugs 38 on the bit end 48 being received by grooves 46. The mating interfit of the lugs 38 with the grooves 46 of the chuck handle body portion 26 secured the bit against rotation relative to the handle. While the bit 16 is being inserted into the chuck, the retaining ring 86 rests on the ledge portion 84 about the slot 74. To prevent the bit 16 falling out of the chuck 42 once inserted therein, a locking device is provided which is actuated upon rotation of the cup 12 so as to align the planar surfaces 122 and 124 of the polygonal shape for the handle 10 and cup 12. As shown in FIG. 9, movement of the cap in the direction of arrow 126 rotates the bushing 62 such that the corresponding diametrically opposing grooves 68 are misaligned with corresponding grooves 46 to capture the lugs 38 of the bit end. Thus the lugs 38 rest on the upper surface 63 of the bushing 62 to lock the bit end 48 in the chuck 42. According to this embodiment of the invention, the device for locking the bit in the chuck is actuated upon rotation of the cup 12 so as to align the surfaces of the polygonal portions. This is a clearly indication to the user that the bit is secured in the chuck and ready for use. To withstand wear and tear on the chuck, should the handle be formed of an appropriate plastic, a metal insert may be provided for the chuck.

The procedure for withdrawing the bit from the chuck and replacing it in its respective channel 32 is reverse of that shown in FIGS. 6 through 9. Since all of the other bits remain in their respective channels, one can readily detect the channel which requires the bit by looking at the periphery of the handle. Once the slots of the bushing are aligned with the slots of the chuck by misaligning the surfaces 122 and 124, the bit end 148 is extracted from the chuck, laterally transferred along the slot 74 into alignment with the respective channel 32. By aligning the lugs 38 with the corresponding groove portions 36 in the channel 32, the bit is slid into the channel until the lug abuts the stop portion 116 at the extremity of the channel 32.

To assist in the aligning or misaligning the cup relative to the screwdriver handle, a spline may be provided about the bushing periphery to engage the wall of the corresponding opening 67 in the handle body 26. By audible clicks, the cup portion 12 may be rotated relative to the handle for setting the cup relative to the handle in either insertion or withdrawal of bit from the chuck or locking the bit end in the chuck.

The multi-bit tool, according to this invention, provides a device which ensures that the bits are never lost. The construction of the bit selector cup and handle is such to permit ready selection of the desired bit, easy withdrawal of the bit from the handle, lateral transfer and insertion of the bit in the chuck. Such arrangement provides an axially aligned position for the bit relative to the handle so that there is no eccentric movement of the handle relative to the bit during use.

With the configuration according to the preferred embodiment, nine tool bits may be located in the handle magazine thus providing three sizes of Robertson heads, three sizes of Philips heads and three sizes of slot heads to handle all standard types of screws.

It is also apparent from the design of this screwdriver that it may be readily injection molded from suitable plastics which would include polypropylene, high dehsity polyethylene and other plastics materials which are well known by those skilled in the art, such as acrylics and the like. The design of the handle with bit secured in the chuck of the handle permits the use of hammer blows and the like to the unit. In this instance, it may be made of high impact plastics to withstand hammer blows.

Although various preferred embodiments of the invention have been described herein in detail, it will be understood by those skilled in the art that variations may be made thereto without departing from the spirit of the invention or the scope of the appended claims.

The embodiments of the invention in which an exclusive property or priviledge is claimed are defined as follows:

1. A multi-bit screwdriver having a handle with a central longitudinal axis, a bit selector cup rotatably mounted at an end of the handle to rotate about said central axis, a plurality of bits provided in a circular pattern about the handle axis, each of which is contained in the handle to extend essentially parallel to the handle's axis, a chuck provided at said handle end aligned with said handle axis for receiving a bit end and securing it against rotation, said cup having a continuous sidewall with an interior surface spaced radially outwardly of the radial location of said bits and a closed cup end, an elongate slot extending from the central portion of the cup end radially outwardly to the radial location of the bits in the handle, said cup being rotatable to position the slot in register with any desired bit in the handle, said slot in said cup end being of sufficient width and length to permit outward withdrawal of a bit from said handle in a direction generally parallel with the handle axis, means for retaining the tool bit end in said cup, said bit end being movable along said slot towards the cup centre into alignment with said chuck for insertion of the tool bit end into said chuck.

2. A multi-bit screwdriver of claim 1, wherein the periphery of said handle is polygonal in shape, the cup having a corresponding shape to match up with the planar wall portions of said handle, the slot in said cup end being positioned relative to a peripheral planar wall of said cup to misalign the polygonal shape of the cup relative to the polygonal shape of said handle when said slot is in register with a desired bit, means for locking said bit in said chuck, said locking means being actuated by rotating said cup periphery into alignment with the polygonal shape of said handle.

3. A multi-bit screwdriver of claim 1, wherein said retaining means is provided for each bit and remains in said cup portion in association with the respective bit.

4. A multi-bit screwdriver of claim 3, wherein said retaining means for each bit comprises a ring surrounding said bit, said ring having a width dimension greater than the width of said slot, said bit end having projections for engagement with said chuck, said ring engaging said projections whereby said ring as it contacts the cup end retains said bit end within said cup.

5. A multi-bit screwdriver of claim 1, wherein said handle has a plurality of channels for individually receiving the bits, said channels being open to the handle periphery to expose at least the bit end in each channel to enable manually pushing of the bit out of the channel through the registered slot of said cup.

6. A multi-bit screwdriver of claim 5, wherein said handle has means for stopping insertion of said bit in the respective channel, the length of each channel to said stop means being less than the length of each said bit, said cup being of a sufficient depth to accommodate the remainder of said bit extending out of its respective channel.

7. A multi-bit screwdriver of claim 6, wherein said retaining means comprises a ring for each bit, said ring surrounding said bit and having a width dimension greater than the width of said slot, said bit end having projections for engagement with said chuck, said ring engaging said projections whereby said ring as it contacts the cup end retains said bit end within said cup.

8. A multi-bit screwdriver of claim 7, wherein said cup has means for supporting said ring inwardly of the working end of the bit when the bit is inserted up to said stop means in said channel, said slot extending through said support means.

9. A multi-bit screwdriver of claim 8, wherein said support means is annular and consists of a raised member provided on the interior of said cup, said raised member being concentric with said handle axis and extending inwardly of the working end portion of said bit as it is inserted to said stop means of said channel, said ring for each bit being supported by said raised members.

10. A multi-bit screwdriver of claim 9, wherein two spaced-apart concentric raised members are provided to define a trough which accommodates the working end of said bit with said ring supported on said raised members.

11. A multi-bit screwdriver of claim 1, wherein said bit end has means for cooperating with said chuck to secure said bit in said chuck against rotation, said cup having means which engages said bit end means and by rotation of said cup, said bit end means is aligned for insertion into said chuck, means for locking said bit end means in said chuck, said bit end locking means being actuated by rotation of said cup after said bit end means is inserted in said chuck.

12. A multi-bit screwdriver of claim 11, wherein said bit is a shaft having a bit working end opposite said bit end, said bit end means protruding of the bit shaft, said retaining means engaging the protruding bit end means to retain said bit end within said cap.

13. A multi-bit screwdriver of claim 12, wherein said retaining means is a ring surrounding each said bit, said ring being of sufficient overall width to prevent passage through said slot to retain thereby said bit end within said cup.

14. A multi-bit screwdriver of claim 11, wherein the periphery of said handle is polygonal in shape, the cup having a corresponding shape to match up with the planar wall portions of said handle, the slot in said cup end being positioned relative to a peripheral planar wall of said cup to misalign the polygonal shape of the cup relative to the polygonal shape of said handle when said slot is in register with a desired bit, said rotation of said cup to actuate said bit end locking means aligns said cup periphery with the polygonal shape of said handle.

15. A multi-bit screwdriver of claim 14, wherein said bit end means comprises a pair of lugs projecting outwardly of the bit shaft, the lugs being planar and lying in a diametrically extending plane, said bit end means for engaging said bit comprising a bushing secured to said cup end and with a bore therethrough, the bushing having opposing recesses in the bore to receive said bit end lugs, said bushing extending towards and terminating proximate said chuck in said handle, said chuck having a bore portion with opposing recesses in the bore to receive said bit end and lugs, said opposing recesses of the cup bushing being aligned with the corresponding recesses in said handle bore to permit insertion of said bit end into said chuck, said bit end locking means comprising the terminal end of said bushing to preclude withdrawal of the bit end from the chuck when the cup is rotated to align the cup periphery with the polygonal shape of said handle.

16. A multi-bit screwdriver of claim 15, wherein said handle has a circular magazine concentric with the handle axis for storing the bits, said magazine comprising a plurality of channels, each channel extending parallel to the handle axis, and having at least one recess extending therealong to receive a corresponding lug of said bit end, said recess having an end which abuts said lug to stop insertion of a bit into the channel when the working end of the bit is within said cup.

17. A multi-bit screwdriver of claim 15, wherein said bushing is supported above and secured to said cup end by a U-shaped wall along each slot side and around the inner portion of the slot, the legs of said U-shaped wall guiding lateral transfer of the withdrawn bit end towards said chuck, said retaining means positioning said bit end in said cup in a manner to permit lateral transfer of the bit end beneath said bushing.

18. A multi-bit screwdriver of claim 17, wherein a magnet is provided on the exterior of the U-shaped wall proximate the inner portion of the slot, said magnet assisting the insertion of the bit end through the bushing into said chuck.

* * * * *